United States Patent [19]

Autenrieth et al.

[11] Patent Number: 4,717,901

[45] Date of Patent: Jan. 5, 1988

[54] ELECTRONIC COMPONENT, ESPECIALLY FOR A CHIP INDUCTANCE

[75] Inventors: Lothar Autenrieth, Hainsacker; Kurt Marth; Josef Schindler, both of Regensburg, all of Fed. Rep. of Germany

[73] Assignee: Siemens Aktiengesellschaft, Berlin and Munich, Fed. Rep. of Germany

[21] Appl. No.: 35,191

[22] Filed: Apr. 6, 1987

Related U.S. Application Data

[63] Continuation of Ser. No. 711,606, Mar. 14, 1985, abandoned.

[30] Foreign Application Priority Data

Mar. 23, 1984 [DE] Fed. Rep. of Germany ..... 3410811

[51] Int. Cl.[4] ..... H01F 15/02; H01F 15/10

[52] U.S. Cl. ..... 336/83; 336/90; 336/96; 336/192

[58] Field of Search ..... 336/83, 192, 65, 221, 336/233, 234, 90, 92, 96

[56] References Cited

U.S. PATENT DOCUMENTS

| | | | |
|---|---|---|---|
| 3,201,729 | 8/1965 | Blanchi et al. | 336/83 |
| 3,315,196 | 4/1967 | Kawahara et al. | 336/83 |
| 3,325,760 | 6/1967 | Bernard | 336/83 X |
| 3,585,553 | 6/1971 | Muckelroy et al. | 336/192 |
| 3,663,913 | 5/1972 | Kato et al. | 336/83 X |
| 3,750,069 | 7/1973 | Renskers | 336/83 |
| 4,245,207 | 1/1981 | Murakami et al. | 336/83 X |
| 4,314,221 | 2/1982 | Satou et al. | 336/192 X |
| 4,427,961 | 1/1984 | Suzuki | 336/83 |

FOREIGN PATENT DOCUMENTS

| | | | |
|---|---|---|---|
| 2452252 | 5/1976 | Fed. Rep. of Germany | 336/83 |
| 114716 | 9/1979 | Japan | 336/83 |
| 70507 | 4/1983 | Japan | 336/192 |
| 694559 | 7/1953 | United Kingdom | 336/83 |
| 2102632 | 2/1983 | United Kingdom . | |

*Primary Examiner*—Thomas J. Kozma

*Attorney, Agent, or Firm*—Herbert L. Lerner; Laurence A. Greenberg

[57] ABSTRACT

An electronic component includes a solid core part having a perpendicular prismatic spatial shape and lateral surfaces, the core part having a recess in the form of a blind hole formed therein defining a winding space, and electrical contact layers disposed on at least some of the lateral surfaces of the core part.

34 Claims, 5 Drawing Figures

ELECTRONIC COMPONENT, ESPECIALLY FOR A CHIP INDUCTANCE

This application is a continuation of application Ser. No. 711,606, now abandoned, filed Mar. 14, 1985.

The invention relates to an electronic component, especially for a chip inductance, such as an RF choke, a transformer, or the like.

Chip inductances are smaller than conventional wired inductances, can be produced at lower cost and are more suitable for use in automatic insertion machines for circuit boards. The conventional chip inductances are partially inductances which are produced by a layer technique or such inductances equipped with rectangular or cylindrical magnetic cores wound with wire.

In order to manufacture the chip inductance by a layer technique, a carrier is coated with a magnetic layer and a conductor run formed in the shape of a coil is applied to this layer. Depending on the desired inductance, the inductance section produced in this manner is combined with further inductance sections to form a stack. Numerous methods which are not explained in detail herein are known for making through-contact for the ends of the coils These chip inductances are distinguished by their space-saving construction, they can be soldered directly to printed circuit boards, and they require no additional wires as connecting elements.

A disadvantage of these devices is their complicated fabrication which is due to the layer technique employed. The layer thickness variations of the magnetic layer which are unavoidable in production, cause undesirable variations of the L and Q values of the inductances. The material for the coil conductor runs must be silver or a silver-palladium alloy, for instance, and a high ohmic resistance of the conductor runs must be tolerated. Since the conductor runs are embedded in the magnetic layer, magnetic saturation already takes place at low values due to the closed magnetic circuit; the magnetic bias d-c properties are accordingly worse. Furthermore, the number of coil turns cannot be chosen at an arbitrarily high number and therefore no arbitrarily high inductance can be set.

Another conventional chip inductance has a rectangular magnetic core with a rectangular cylindrical center part used as the winding support and flanges which are integrally formed at this support and likewise have a rectangular cross section. Contact of the winding ends is made by means of electrically conducting layers which are disposed at end faces of the flanges and to which the winding ends are soldered. The winding is embedded in resin which forms a slab together with the flanges.

In order to correct the inherent disadvantages of these prior art chip inductances, partly from a production point of view and partly electrically and magnetically, a chip inductance has been proposed which was equipped with a ferrite roll core. The wound roll core is embedded in this case in a slab-shaped casting compound. The ends of strip-shaped connecting elements rest against one end face of the slab. The connecting elements are contacted at their other ends by electrically conducting solderable layers of the end faces of the roll core flanges. Such a device is shown in German Published, Non-Prosecuted Application DE-OS No. 32 25 782. It is a disadvantage of this construction that the externally connected elements require two fabrication steps which are furthermore interrupted by a casting process, namely, first making contact with the outer end faces of the ferrite roll core, and finally, after the casting is completed, the final beading-over in the direction parallel to the corresponding end faces of the slab created by the casting.

It is accordingly an object of the invention to provide an electronic component for a chip inductance which overcomes the hereinafore-mentioned disadvantages of the heretofore-known devices of this general type, which can be manufactured at low cost, which permits the manufacture of chip inductances such as RF chokes that can be shielded to a large extent, which can be contacted without adversely affecting quality, and which can otherwise enable small as well as large inductances with a high Q-factor to be produced.

With the foregoing and other objects in view there is provided, in accordance with the invention, an electronic component, especially for a chip inductance, comprising a solid core part having a perpendicular prismatic spatial shape and lateral surfaces, the core part having a recess in the form of a blind hole formed therein defining a winding space, and electrical contact layers or surfaces disposed on at least some of the lateral surfaces, such as separate surfaces, of the core part.

If the solid core part is formed of an electrically non-conducting material such as ceramics or plastic, it is suitable, for instance, for making so-called air core coils of chip-type construction. If ferromagnetic materials are used for the core part, the core part preferably serves for creating RF choke chips or transformer chips, etc.

With appropriate construction, the electronic component can also be considered as a quasi half shell core which can be combined with a second, normally identical component, to form a magnetically closed core. However, a magnetic return can also be produced by coverings of ferromagnetic material which are applied to the lateral surface formed with the recess of the component as will be explained below.

In accordance with another feature of the invention, the core part is a cube or slab.

In accordance with a further feature of the invention, the core part is formed of ferromagnetic material or electrically non-conductive material.

In accordance with an added feature of the invention, the core part is formed of a material from the group consisting of ferrite, ceramic and plastic.

In accordance with an additional feature of the invention, the lateral surfaces of the core part on which the contact layers are disposed have open-ended canals formed therein communicating with the recess.

In accordance with again another feature of the invention, the contact layers preferably completely cover mutually opposite lateral surfaces of the core part.

In accordance with again a further feature of the invention, the lateral surfaces have edges, and the contact layers extend beyond the edges toward adjacent lateral surfaces.

In accordance with again an added feature of the invention, the contact layers extend at least partially into the canals.

In accordance with again an additional feature of the invention, there is provided a solderable layer covering the contact layers.

In accordance with yet another feature of the invention, given corners of the core part are bevelled for indicating proper alignment or direction.

In accordance with yet a further feature of the invention, the core part has a pad integral therewith, and the recess has a hollow cylindrical shape enclosing the pad.

The pad serves as the winding support and is connected by a canal which is open at the edge for winding ends with contact surfaces at opposite lateral surfaces of the core parts. If this component is used for an electric coil, for instance, the electric winding is slipped onto the pad and the winding ends are brought through the canals to the electrical contact layers and contact is made with the contact layers.

In accordance with yet an added feature of the invention, the recess is formed in the lateral surfaces defining a corner of the core part, the pad has an end surface set back from the corner, and including a circular disc-shaped cover covering the end surface and closing off the recess.

In accordance with yet an additional feature of the invention, the cover is level with the lateral surfaces.

In accordance with still another feature of the invention, the recess is formed in the lateral surfaces defining an edge of the lateral surfaces, the edge has an offset surface formed therein set back from the edge, the pad has an end surface set back from the edge, and including a cover covering the offset surface and the end surface.

In accordance with still a further feature of the invention, the cover is formed of a material from the group consisting of ferrite, ceramic and plastic.

In accordance with still an added feature of the invention, the core part has a pad integral therewith, the recess has a hollow cylindrical shape enclosing the pad, and including at least one winding disposed on the pad and having ends extended through canals and being in contact with the contact layers.

In accordance with still an additional feature of the invention, there is provided casting compound such as epoxy resin surrounding at least part of the winding and possibly the winding ends.

In accordance with a concomitant feature of the invention, the casting compound includes a material from the group consisting of carbonyl iron and ferrite powder.

The required magnetic return can be created by a covering of ferromagnetic material or by casting resin which is mixed with carbonyl iron or ferrite powder and which fills the empty space in the canals of the recess.

Other features which are considered as characteristic for the invention are set forth in the appended claims.

Although the invention is illustrated and described herein as embodied in an electronic component, especially for a chip inductance, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
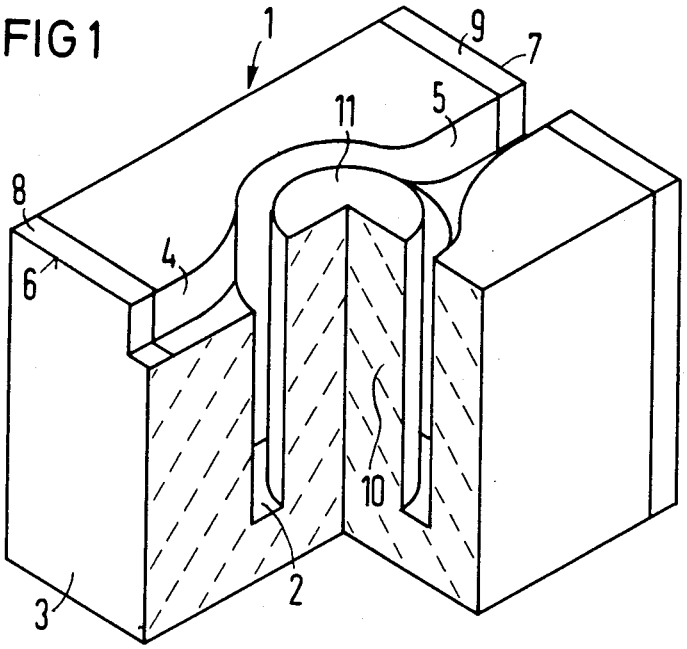
FIG. 1 is a diagrammatic, partially cross-sectional perspective view of an electronic component according to the invention.

Referring now to the figures of the drawings in detail, in which like parts are designated with the same reference symbols, and first particularly to FIG. 1 thereof, there is seen a component for a chip inductance such as an RF choke or transformer which has a solid core part 1. Depending on the inductance to be created, the core part 1 is to be made of a ferromagnetic material, especially ferrite or, if an air core coil is to be manufactured in chip construction, for instance, the core part 1 is to be made of electrically non-conducting material, especially ceramic or plastic. The core part 1 itself has a perpendicular prismatic spatial shape, preferably a cube or slab. Vertical prismatic spatial shapes appearing pentagonal and polygonal as seen in a top view, are also conceivable.

Figure 2:
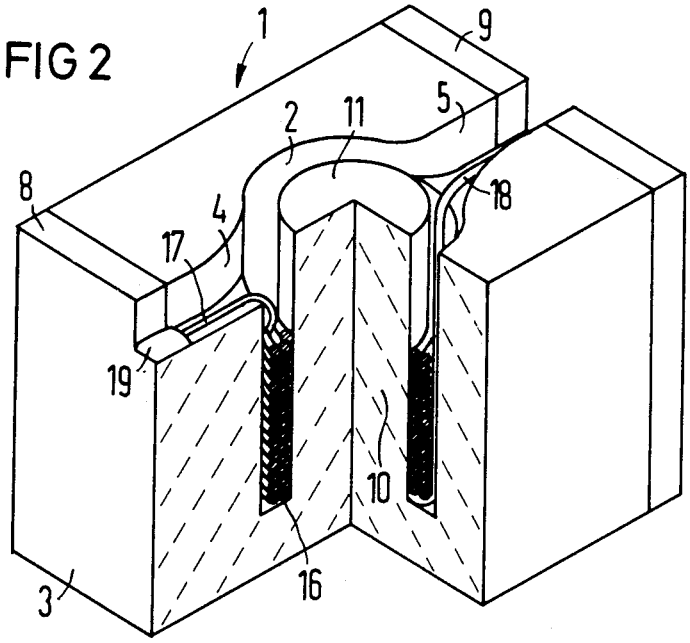
FIG. 2 is a view of the electronic component according to FIG. 1, with an assembled electric winding.

A hollow cylindrical recess 2 which surrounds a pad 10 serves as the winding space for a winding 16, for instance, shown in FIG. 2. The hollow cylindrical recess 2 can be replaced by a recess which is free of pads and exclusively has the shape of a blind hole, especially for core parts formed of ceramic or plastic, such as are preferably used for air core coils.

Mutually opposite lateral surfaces of the core part 1 are covered with electrically conducting contact layers or surfaces 3 which are deposited on these lateral surfaces by the so-called nickel-carbonyl method, for instance, and are coated with high-melting solder. Canals 4, 5 which are open at the edge and lead from the contact surfaces 3 to the recess 2, are provided in order to bring winding ends 17, 18 of the winding 16 to the contact surfaces 3. The contact surfaces 3 which preferably cover the entire lateral surfaces, advantageously extend over end edges 6, 7 to the adjoining lateral surfaces and to edge regions 8, 9 of these lateral surfaces. If a mirror-symmetrical arrangement of a second core part on the first core part is used, for instance, this facilitates the connection of the two core parts and in addition, it facilitates making a contact 19 between the winding ends 17, 18 and the contact layers or surfaces 3.

Figure 3:
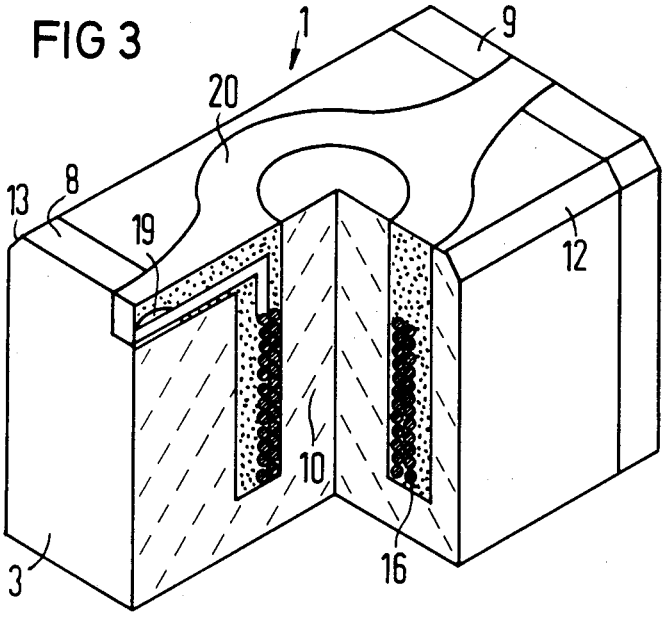
FIG. 3 is a view similar to FIG. 1 of an RF choke in a second embodiment of an electronic component according to the invention.

Corresponding end corners 12, 13 of the core part 1 are bevelled, as is shown in FIG. 3, for automatic direction detection, i.e. for identifying the position or direction of a chip, which is advantageous during the use of these chips for automatic insertion machines, such as for printed circuit boards, as shown in FIG. 3. This permits a reliable detection of the chip direction and positioning of the leads with respect to the circuit board, to be made.

Figure 4:
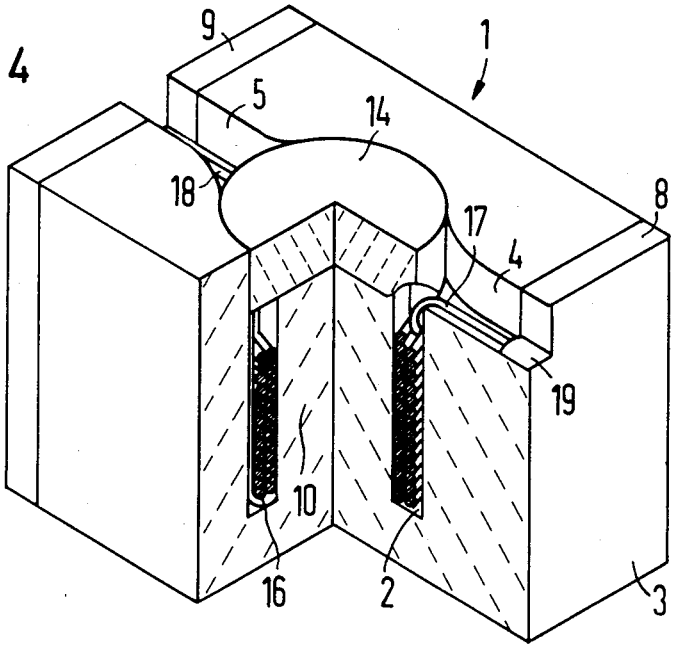
FIG. 4 is another view similar to FIG. 1 of a further embodiment of an RF choke with an electronic component which is modified as compared to FIGS. 1 to 3.
Figure 5:
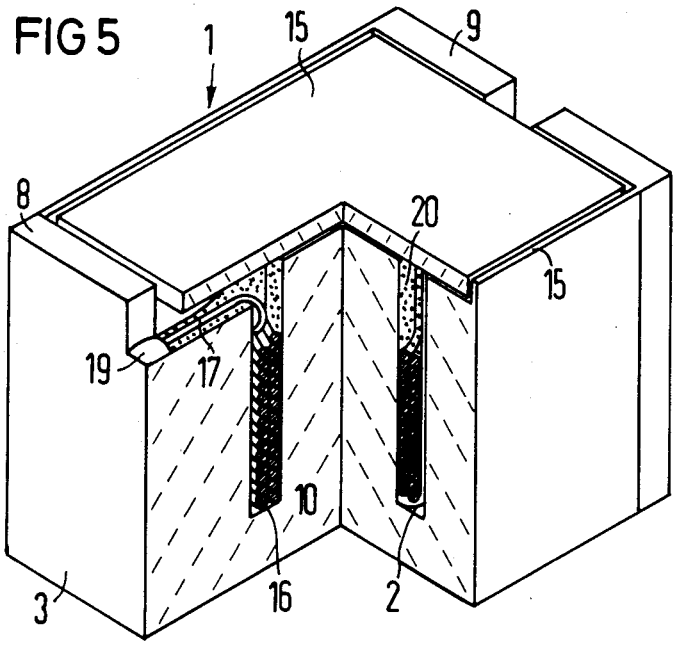
FIG. 5 is yet another view similar to FIG. 1 of an additional embodiment of an RF choke with an electronic component that is different from FIGS. 1 to 4.

The end face or surface 11 of the pad 10 can be flush with the recessed lateral surface of the core part 1 or it can be set back relative to the end corner of the recess 2, as shown in FIGS. 4 and 5. In the two last-mentioned cases, the component additionally has a disk-shaped cover 14 as seen in FIG. 4 or a rectangular cover 15 as shown in FIG. 5. The free or exposed end faces of the covers 14 or 15, respectively, are preferably flush with the recessed lateral surface of the core part 1. To this end, the lateral surface carrying the cover 15 together with the end face 11 of the pad 10 can be set back or recessed relative to the edge portions 21 of the lateral surface, by an amount equal to the cover thickness.

The type of cover which is ultimately chosen in the case of core parts and covers formed of ferrite, essentially depends on the requirements of the magnetic return. It is also conceivable to embed the winding 16 or to cast the winding 16 or to cast the recess 2 together with the canals 4, 5 full of casting compound 20 as is shown in FIG. 3 or in addition to the cover 15 shown in FIG. 5. Epoxy resin which is mixed with carbonyl iron or ferrite powder for generating or increasing the magnetic shielding effect of the chip inductance with carbonyl iron or ferrite powder, is particularly useful.

As already mentioned, the core parts 1 can be constructed in the form of quasi shell core halves which have corresponding set-back pad end faces 11, depending on the desired air gap, which are always in pairs and disposed on top of each other with mirror symmetry, so that cores with excellent magnetic return are thus obtained.

The foregoing is a description corresponding in substance to German Application No. P 34 10 811.4, filed Mar. 23, 1984, the International priority of which is being claims for the instant applicantion, and which is hereby made part of this application. Any material discrepancies between the foregoing specification and the aforementioned corresponding German application are to be resolved in favor of the latter.

We claim:

1. Chip inductance comprising a solid core part having a perpendicular prismatic spatial shape; the core part having a hollow-cylindrical recess therein shaped for receiving a winding, said recess surrounding a pad being contiguous in one piece with the core part and canals connecting the lateral surfaces of the core part with the recess; the canals being open in direcion facing away from the core part; electrical contact surfaces being supported by said lateral surfaces; and at least one winding wound onto the pad; the ends of the winding being guided through the canals to the electric contact surfaces and connected therewith.

2. Electronic component according to claim 1, wherein said core part is a cube.

3. Electronic component according to claim 1, wherein said core part is a slab.

4. Electronic component according to claim 1, wherein said core part is formed of ferromagnetic material.

5. Electronic component according to claim 1, wherein said core part is formed of electrically non-conductive material.

6. Electronic component according to claim 1, wherein said core part is formed of a material from the group consisting of ferrite, ceramic and plastic.

7. Electronic component according to claim 1, wherein said lateral surfaces of said core part on which said contact layers are disposed have open-ended canals formed therein communicating with said recess.

8. Electronic component acording to claim 7, wherein said contact layers completely cover mutually opposite lateral surfaces of said core part.

9. Electronic component according to claim 8, wherein said lateral surfaces have edges, and said contact layers extend beyond said edges toward adjacent lateral surfaces.

10. Electronic component according to claim 7, wherein said contact layers extend at least partially into said canals.

11. Electronic component according to claim 1, including a solderable layer covering said contact layers.

12. Electronic component according to claim 1, wherein given corners of said core part are bevelled for indicating proper alignment.

13. Electronic component according to claim 1, wherein said core part has a pad integral therewith, and said recess has a hollow cylindrical shape enclosing said pad.

14. Electronic component according to claim 13, wherein said recess is formed in said lateral surfaces defining a corner of said core part, said pad has an end surface set back from said corner, and including a circular disc-shaped cover covering said end surface and closing off said recess.

15. Electronic component according to claim 14, wherein said cover is level with said lateral surfaces.

16. Electronic component according to claim 13, wherein said recess is formed in said lateral surfaces defining an edge of said lateral surfaces, said edge has an offset surface formed therein set back from said edge, said pad has an end surface set back from said edge, and including a cover covering said offset surface and said end surface.

17. Electronic component according to claim 14, wherein said cover is formed of a material selected from the group consisting of ferrite, ceramic and plastic.

18. Electronic component according to claim 16, wherein said cover is formed of a material selected from the group consisting of ferrite, ceramic and plastic.

19. Electronic component according to claim 7, wherein said core part has a pad integral therewith, said recess has a hollow cylindrical shape enclosing said pad, and including at least one winding disposed on said pad and having ends extended through said canals and being in contact with said contact layers.

20. Electronic component according to claim 19, including casting compound surrounding at least part of said winding.

21. Electronic component according to claim 20, wherein said casting compound includes a material selected from the group consisting of carbonyl iron and ferrite powder.

22. Chip inductance according to claim 1, wherein said pad consists of ferromagnetic material.

23. Chip inductance according to claim 1, wherein said core part and pad consist of electrically non-conductive material.

24. Chip inductance according to claim 1, wherein the electrical contact surfaces extend partially into the canals.

25. Chip inductance according to claim 1, wherein the electrical contact surfaces are covered with a solderable layer.

26. Chip inductance according to claim 1, wherein at least the winding is cast into a casting compound.

27. Chip inductance according to claim 26, wherein the casting compound includes carbonyl-iron.

28. Chip inductance according to claim 26, wherein the casting compound includes ferrite powder.

29. Chip inductance according to claim 26 wherein the winding ends are cast into a casting compound.

30. Chip inductance according to claim 26 wherein said casting compound includes epoxy resin.

31. Chip inductance according to claim 29 wherein said casting compound includes epoxy resin.

32. Chip inductance according to claim 30 wherein said casting compound includes carbonyl iron.

33. Chip inductance according to claim 31 wherein said casting compound includes carbonyl iron.

34. Chip inductance according to claim 29 wherein said casting compound includes ferrite powder.

* * * * *